US009631335B2

(12) United States Patent
Reusing et al.

(10) Patent No.: US 9,631,335 B2
(45) Date of Patent: Apr. 25, 2017

(54) PILE, PILE HEAD AND CONNECTOR THEREFOR

(71) Applicant: GOLIATHTECH INC., Magog (CA)

(72) Inventors: Julian L. Reusing, Magog (CA); Predrag Pudar, Montreal (CA)

(73) Assignee: GOLIATHTECH INC., Magog (CA)

( * ) Notice: Subject to any disclaimer, the term of this patent is extended or adjusted under 35 U.S.C. 154(b) by 0 days.

(21) Appl. No.: 14/423,878

(22) PCT Filed: Aug. 22, 2014

(86) PCT No.: PCT/CA2014/000645

§ 371 (c)(1),
(2) Date: Feb. 25, 2015

(87) PCT Pub. No.: WO2015/024108

PCT Pub. Date: Feb. 26, 2015

(65) Prior Publication Data

US 2016/0215470 A1 Jul. 28, 2016

Related U.S. Application Data

(60) Provisional application No. 61/868,773, filed on Aug. 22, 2013.

(51) Int. Cl.
*E02D 35/00* (2006.01)
*E02D 5/52* (2006.01)
(Continued)

(52) U.S. Cl.
CPC ..... *E02D 5/56* (2013.01); *E02D 5/223* (2013.01); *E02D 5/526* (2013.01); *E02D 35/005* (2013.01); *E02D 2600/20* (2013.01)

(58) Field of Classification Search
CPC ..... E02D 35/00; E02D 35/005; E02D 5/56; E02D 5/223; E02D 5/52; E02D 5/523; E02D 5/526
See application file for complete search history.

(56) References Cited

U.S. PATENT DOCUMENTS 4,870,789 A * 10/1989 Clark ..... E04B 1/34352 248/354.3
5,707,180 A 1/1998 Vickars et al.
(Continued)

FOREIGN PATENT DOCUMENTS

AU 2013200834 A1 9/2013
CA 2419381 A1 * 5/2003 ..... E02D 27/01
(Continued)

OTHER PUBLICATIONS

First Examination Report issued May 11, 2016 in corresponding New Zealand Application No. 716857.

*Primary Examiner* — Frederick L Lagman
(74) *Attorney, Agent, or Firm* — Mintz Levin Cohn Ferris Glovsky and Popeo, P.C.; Steven M. Jensen

(57) ABSTRACT

A pile head for a screw pile having a top end and a longitudinal axis is provided. The pile head comprises a mounting portion engaging the pile and an extendable portion movably mounted to the mounting portion. The extendable portion is movable relative to the mounting portion, along the longitudinal axis. A first fastening means is used to removably fasten the mounting portion of the pile head to the top end of the pile and preventing unwanted movement of the pile head relative to the pile, along the longitudinal axis. A screw pile, a removable helical member and a body extension for a screw pile are also provided.

42 Claims, 13 Drawing Sheets

(51) Int. Cl.
*E02D 5/56* (2006.01)
*E02D 5/22* (2006.01)

(56) References Cited

U.S. PATENT DOCUMENTS 5,980,160 A * 11/1999 Vanderklaauw ..... B66F 1/00 182/178.1
6,074,133 A * 6/2000 Kelsey ..... E02D 35/00 405/244
6,183,167 B1 * 2/2001 Ruiz ..... E02D 5/285 403/379.3
6,347,489 B1 * 2/2002 Marshall, Jr. ..... E02D 27/00 248/354.5
6,682,267 B1 * 1/2004 Jones ..... E02D 5/523 405/230
6,817,810 B2 * 11/2004 Jones ..... E02D 5/523 405/230
6,848,864 B1 * 2/2005 Davie, Jr. ..... E02D 27/48 405/230
7,220,081 B1 * 5/2007 Gantt, Jr. ..... E02D 27/12 405/230
7,744,316 B2 * 6/2010 Kaufman ..... E02D 35/00 405/230
8,734,058 B1 * 5/2014 Schmidt ..... E02D 5/64 405/255
2005/0074298 A1 * 4/2005 Jones ..... E02D 5/56 405/252.1
2006/0067794 A1 * 3/2006 Mitchell ..... E02D 35/00 405/230
2007/0028557 A1 * 2/2007 Kelly ..... E02D 27/34 52/741.15
2008/0063479 A1 3/2008 Stroyer
2010/0143048 A1 * 6/2010 Lin ..... E02D 5/523 405/244
2010/0166504 A1 * 7/2010 Patton ..... E02D 5/00 405/230
2012/0255242 A1 * 10/2012 Patton ..... E02D 5/00 52/126.6
2013/0309024 A1 * 11/2013 Jones ..... E02D 5/56 405/252.1
2014/0356075 A1 * 12/2014 Hale ..... E02D 27/16 405/230
2014/0356076 A1 * 12/2014 Hale ..... E02D 5/223 405/255

FOREIGN PATENT DOCUMENTS

JP 2002-348861 A 12/2002
JP 2009-035937 A 2/2009
KR 10-1081566 B1 11/2011
NZ 299662 A 6/1998

* cited by examiner

PILE, PILE HEAD AND CONNECTOR THEREFOR

CROSS-REFERENCE

This application is a National Phase application filed under 35 USC 371 of PCT International Application No. PCT/CA2014/000645 with an International Filing Date of Aug. 22, 2014, which claims under 35 U.S.C. §119(e) the benefit of U.S. provisional patent application No. 61/868,773, filed Aug. 22, 2013, the contents of which are hereby incorporated by reference.

BACKGROUND

The use of screw piles is an alternative to the use of concrete foundations in different residential, commercial, recreational or agricultural applications. Resembling large screws, screw piles are typically installed deep into the ground to support structures such as decks, sun rooms, cart ports and the like.

A screw pile generally includes an elongated cylindrical, hollow pile body having the general configuration of a metal pipe. The hollow pile body comprises an upper end and a lower end to which is welded a helical member, which is used to screw the pile into the ground and to provide vertical stability once the screw pile is properly installed. Mounted to the upper end of the pile body is a pile head configured to receive or support a structure.

Various configurations of the pile heads are known. In some configurations, the pile head simply consists of a plate or platform fixedly attached to the upper end of the pile body (e.g. by welding), which extends generally horizontally when the screw pile is installed. In other configurations, a plate or platform is fixedly attached to an adaptor which can be received and rest on the upper end of the pile body. In such configurations, the adaptor generally takes the form of a relatively short cylinder having a diameter smaller than the diameter of the pile body. Once pile head is mounted to the pile body, the adaptor is received in a cylindrical cavity defined at the upper end of the pile body while the plate or platform abuts the upper edge of the pile body, thereby preventing downward movement of the pile head relative to the pile body. In such configurations, the screw piles do not offer an adjustment of the height of the platform once the screw pile is installed which may, in some instances, require further positioning of the entire screw pile relative to the ground. Since the installation of screw piles generally requires the use of relatively heavy equipment, such adjustment may be burdensome and provide unsatisfactory results.

In other configurations, the distance between the platform and the upper end of the pile body is adjustable. In known configurations, pile heads typically include an adaptor resting on the upper end of the pile body, the adaptor comprising a relatively short cylindrical member receivable into the cylindrical cavity of the pile body and a circular plate welded to the upper end of the short cylindrical member and designed to rest on the upper edge of the pile body (see FIG. 1). Defined on the circular plate of the adaptor is a bore for adjustably mounting a platform. In such prior art configuration, the platform includes a bolt having a lower end and an upper end to which is welded a plate. The bolt is sized such that its lower end is slidably engageable in the bore of the adaptor. To allow modification or adjustment of the distance between the plate and the adaptor, and thereby provide vertical adjustment to the pile head, a nut is provided. The nut sized and shaped to engage the threads of the bolt while resting on the circular face of the adaptor. Once a structure is mounted on the platform, adjusting the distance between the top of the pile body and the structure is made possible by turning the nut in one direction (to move the platform upwardly) or in the other direction (to move the platform downwardly).

As it will be appreciated, the bore defined in the circular plate of the adaptor must be sufficiently large to allow vertical displacement of the bolt therein, without damaging the threads. Therefore, when the screw piles offer adjustment, the bolt tend to be loose in the bore and some lateral movement of the bolt is susceptible to occur relative to the adaptor (see FIG. 1), which lateral movement is transferred to the plate and the structure mounted thereto. Further the screw piles of the art tend not to be satisfactory because they are not adapted to prevent upward movement of the structure relative to the screw pile (e.g. in instances of high winds lifting structures such as decks) because the adaptor is maintained into position of the pile body by gravity. To avoid such upward movement of the platform, it is still possible to fasten the platform to the top of the pile (e.g. by welding). This, however, is difficult to achieve on the field and, alternatively, makes the installation of the pile more complex if the platform is already attached to the pile at the time of installation.

Therefore, there exists a need for a new screw pile that alleviate at least some of the drawbacks of the prior art.

BRIEF SUMMARY

According to a broad aspect, there is provided a screw pile comprising:

- a pile body having a top end, a bottom end and a wall extending therebetween, the pile body defining a longitudinal axis of the screw pile;
- a helical member mounted to the bottom end of the pile body;
- a pile head mounted to the top end of the pile body, the pile head including a mounting portion engaging the pile body and an extendable portion movably mounted to the mounting portion, the extendable portion being movable relative to the mounting portion, along the longitudinal axis; and
- a first fastening means for removably fastening the mounting portion of the pile head to the top end of the pile body and preventing unwanted movement of the pile head relative to the pile body, along the longitudinal axis.

According to one feature, the mounting portion of the pile head comprises a sleeve portion engaging the top end of the pile body and including a top end and a bottom end, and a plate portion mounted to the top end of the sleeve portion, the extendable portion being mounted to the plate portion.

According to another feature, the plate portion of the mounting portion comprises a threaded hole extending along the longitudinal axis, and the extendable portion comprises a threaded shaft. The threaded shaft of the extendable portion threadably engaging the threaded hole of the plate portion for allowing movement of the extendable portion relative to the mounting portion, along the longitudinal axis. Preferably, the threaded shaft of the extendable portion comprises a top end, a bottom end and a threaded surface extending therebetween and the extendable portion further comprising a support member mounted to the top end of the threaded shaft.

According to yet another feature, the support member is configured to support a structure thereon. Preferably, the structure is selected from a group consisting of a beam, a fence, a deck, a sun room, a cart port and a cabin.

According to an additional feature, the pile body and the sleeve portion of the mounting portion of the pile head are generally cylindrical.

According to yet another feature, the plate portion of the mounting portion is configured to receive a tool for urging rotation of the mounting portion relative to the pile body when the fastening means is removed, thereby urging movement of the extendable portion relative to the mounting portion, along the longitudinal axis. Preferably, the plate portion comprises a top face, a bottom face in contact with the sleeve portion and at least one side face extending between the top and bottom faces. More preferably, the top and bottom faces of the plate portion are hexagonal.

According to still another feature the pile body comprises at least one bore defined at the top end thereof and the sleeve portion comprises at least one corresponding hole defined in the sleeve portion, the at least one hole of the sleeve portion being in alignment with the at least one bore of the pile body to receive the first fastening means therein. Preferably, the first fastening means comprises at least one threaded fastener. More preferably, the at least one bore defined at the top end of the pile body is a threaded bore and the at least one threaded fastener includes at least one bolt, the at least one bolt engaging the threaded bore of the pile body.

According to a further feature, the helical member is removable. Preferably, the removable helical member comprises a sleeve portion engageable about the bottom end of the pile body, a twisted member secured to the sleeve portion of the removable helical member and defining a helix, and a second fastening means for fastening the removable helical member to the bottom end of the pile body. More preferably, the removable helical member comprises at least one pair of holes defined in the sleeve portion thereof, and the bottom end of the pile body comprises at least one pair of corresponding holes, the holes of the removable helical member being in alignment with the holes defined at the bottom end of the pile body to receive the second fastening means therein. Still more preferably, the second fastening means comprises at least one threaded fastener. In one example, the at least one threaded fastener includes at least one bolt and at least one nut.

According to another broad aspect, there is provided a screw pile comprising:

- a pile body having a top end, a bottom end and a wall extending therebetween, the pile body defining a longitudinal axis of the screw pile;
- at least one body extension mounted to the top end of the pile body, the at least one body extension having a top end, a bottom end and a wall extending therebetween, the body extension further having a connection portion at the bottom end thereof, the top end of the pile body being engaged in the connection portion of the body extension;
- a first fastening means for removably fastening the body extension to the pile body;
- a helical member mounted to the bottom end of the pile body;
- a pile head mounted to the top end of the at least one body extension, the pile head including a mounting portion engaging the pile body and an extendable portion movably mounted to the mounting portion, the extendable portion being movable relative to the mounting portion, along the longitudinal axis; and
- a second fastening means for removably fastening the mounting portion of the pile head to the top end of the body extension and preventing unwanted movement of the pile head relative to the body extension, along the longitudinal axis.

According to one feature, the mounting portion of the pile head comprises a sleeve portion engaging the top end of the body extension and including a top end and a bottom end, and a plate portion mounted to the top end of the sleeve portion, the extendable portion being mounted to the plate portion. Preferably, the plate portion of the mounting portion comprises a threaded hole extending along the longitudinal axis, and the extendable portion comprises a threaded shaft, the threaded shaft of the extendable portion threadably engaging the threaded hole of the plate portion for allowing movement of the extendable portion relative to the mounting portion, along the longitudinal axis. More preferably, the threaded shaft of the extendable portion comprises a top end, a bottom end and a threaded surface extending therebetween, the extendable portion further comprising a support member mounted to the top end of the threaded shaft. Even more preferably, the support member is configured to support a structure thereon, where the structure is preferably selected from a group consisting of a beam, a fence, a deck, a sun room, a cart port and a cabin.

According to another feature, the body extension and the sleeve portion of the mounting portion of the pile head are generally cylindrical. Preferably, the plate portion of the mounting portion is configured to receive a tool for urging rotation of the mounting portion relative to body extension when the second fastening means is removed, thereby urging movement of the extendable portion relative to the mounting portion, along the longitudinal axis. More preferably, the plate portion comprises a top face, a bottom face in contact with the sleeve portion and at least one side face extending between the top and bottom faces. Even more preferably, the top and bottom faces of the plate portion are hexagonal.

According to yet another feature, the body extension comprises at least one bore defined at the top end thereof and the sleeve portion comprises at least one corresponding hole defined in the sleeve portion, the at least one hole of the sleeve portion being in alignment with the at least one bore of the body extension to receive the second fastening means therein. Preferably, the second fastening means comprises at least one threaded fastener. More preferably, the at least one bore defined at the top end of the body extension is a threaded bore and the at least one threaded fastener includes at least one bolt, the at least one bolt engaging the threaded bore of the body extension.

According to still another feature, the helical member is removable. Preferably, the removable helical member comprises a sleeve portion engageable about the bottom end of the pile body, a twisted member secured to the sleeve portion of the removable helical member and defining a helix, and a third fastening means for fastening the removable helical member to the bottom end of the pile body. More preferably, the removable helical member comprises at least one pair of holes defined in the sleeve portion thereof, and the bottom end of the pile body comprises at least one pair of corresponding holes, the holes of the removable helical member being in alignment with the holes defined at the bottom end of the pile body to receive the third fastening means therein, where the third fastening means comprises at least one threaded fastener. The at least one threaded fastener may include at least one bolt and at least one corresponding nut.

According to still another broad aspect, there is provided a kit for a screw pile as described above.

According to yet another broad aspect, there is provided a pile head for a pile having a top end and a longitudinal axis, the pile head comprising:

a mounting portion engaging the pile and an extendable portion movably mounted to the mounting portion, the extendable portion being movable relative to the mounting portion, along the longitudinal axis; and a first fastening means for removably fastening the mounting portion of the pile head to the top end of the pile and preventing unwanted movement of the pile head relative to the pile, along the longitudinal axis.

According to one feature, the pile is a screw pile.

According to another feature, the mounting portion of the pile head comprises a sleeve portion engaging the top end of the pile and includes a top end and a bottom end, and a plate portion mounted to the top end of the sleeve portion, the extendable portion being mounted to the plate portion.

According to still another feature, the plate portion of the mounting portion comprises a threaded hole extending along the longitudinal axis, and the extendable portion comprises a threaded shaft, the threaded shaft of the extendable portion threadably engaging the threaded hole of the plate portion for allowing movement of the extendable portion relative to the mounting portion, along the longitudinal axis. Preferably, the threaded shaft of the extendable portion comprises a top end, a bottom end and a threaded surface extending therebetween, the extendable portion further comprising a support member mounted to the top end of the threaded shaft.

According to yet another feature, wherein the support member is configured to support a structure thereon, the structure is preferably selected from a group consisting of a beam, a fence, a deck, a sun room, a cart port and a cabin.

According to an additional feature, the pile and the sleeve portions of the mounting portion of the pile head are generally cylindrical. Preferably the plate portion of the mounting portion is configured to receive a tool for urging rotation of the mounting portion relative to body extension when the second fastening means is removed, thereby urging movement of the extendable portion relative to the mounting portion, along the longitudinal axis. More preferably, the plate portion comprises a top face, a bottom face in contact with the sleeve portion and at least one side face extending between the top and bottom faces. Even more preferably, the top and bottom faces of the plate portion are hexagonal.

According to yet an additional feature, the pile comprises at least one bore defined at the top end thereof and the sleeve portion comprises at least one corresponding hole defined in the sleeve portion, the at least one hole of the sleeve portion being in alignment with the at least one bore of the pile to receive the first fastening means therein. Preferably, the first fastening means comprises at least one threaded fastener. More preferably, the at least one bore defined at the top end of the pile is a threaded bore and the at least one threaded fastener includes at least one bolt, the at least one bolt engaging the threaded bore of the pile.

According to another broad aspect, there is provided a removable helical member for a screw pile including a pile body having a top end, a bottom end and a wall extending therebetween, the pile body defining a longitudinal axis of the screw pile, the removable helical member comprising:

a sleeve portion engageable about the bottom end of the pile body;

a twisted member secured to the sleeve portion and defining a helix; and a first fastening means for fastening the removable helical member to the bottom end of the pile body.

In one feature, the removable helical member comprises a sleeve portion engageable about the bottom end of the pile body, a twisted member secured to the sleeve portion of the removable helical member and defining a helix, and a third fastening means for fastening the removable helical member to the bottom end of the pile body. Preferably, the removable helical member further comprises at least one pair of holes defined in the sleeve portion thereof, and the bottom end of the pile body comprises at least one pair of corresponding holes, the holes of the removable helical member being in alignment with the holes defined at the bottom end of the pile body to receive the first fastening means therein. More preferably, the first fastening means comprises at least one threaded fastener, where the at least one threaded fastener may include at least one bolt and at least one nut.

According to yet a further broad aspect, there is provided a body extension for a screw pile including a pile body having a top end, a bottom end and a wall extending therebetween, the pile body defining a longitudinal axis of the screw pile, the body extension comprising:

a top end;

a bottom end;

a wall extending between the top end and the bottom end;

a connection portion extending at the bottom end, the connection portion being configured to engage the top end of the pile body; and a first fastening means for removably fastening the body extension to the pile body.

Additional and/or alternative features, aspects, and advantages of embodiments of the present will become apparent from the following description, the accompanying drawings, and the appended claims.

BRIEF DESCRIPTION OF THE DRAWINGS

For a better understanding of the present, as well as other aspects, and further features thereof, reference is made to the following description which is to be used in conjunction with the accompanying drawings, where.

DETAILED DESCRIPTION

Figure 1:
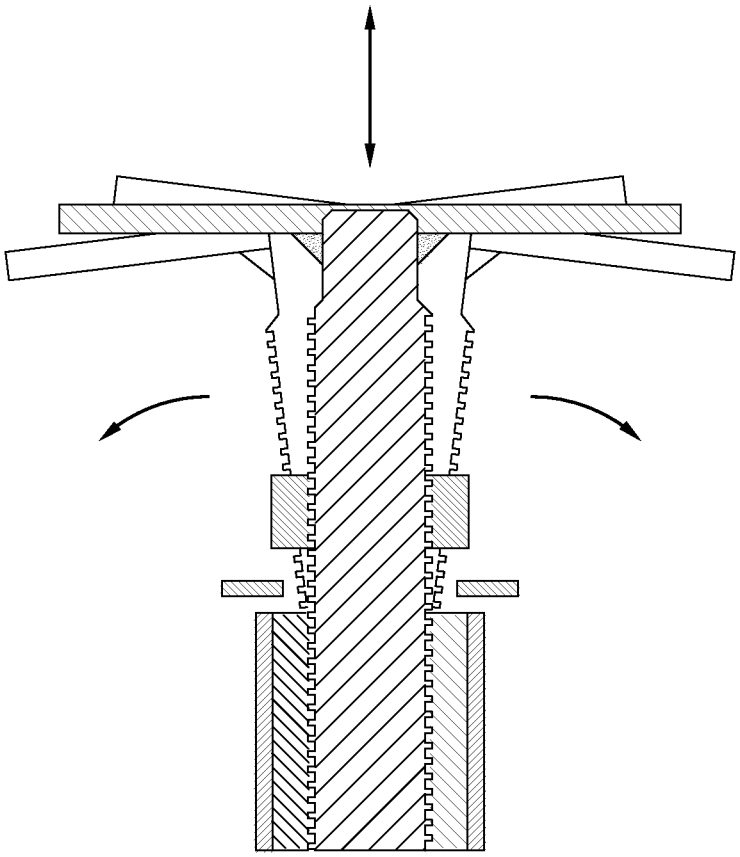
FIG.1 (Prior Art)
FIG. 1 is a cross-section view of a pile head for a screw pile, according to the prior art.
Figure 2:
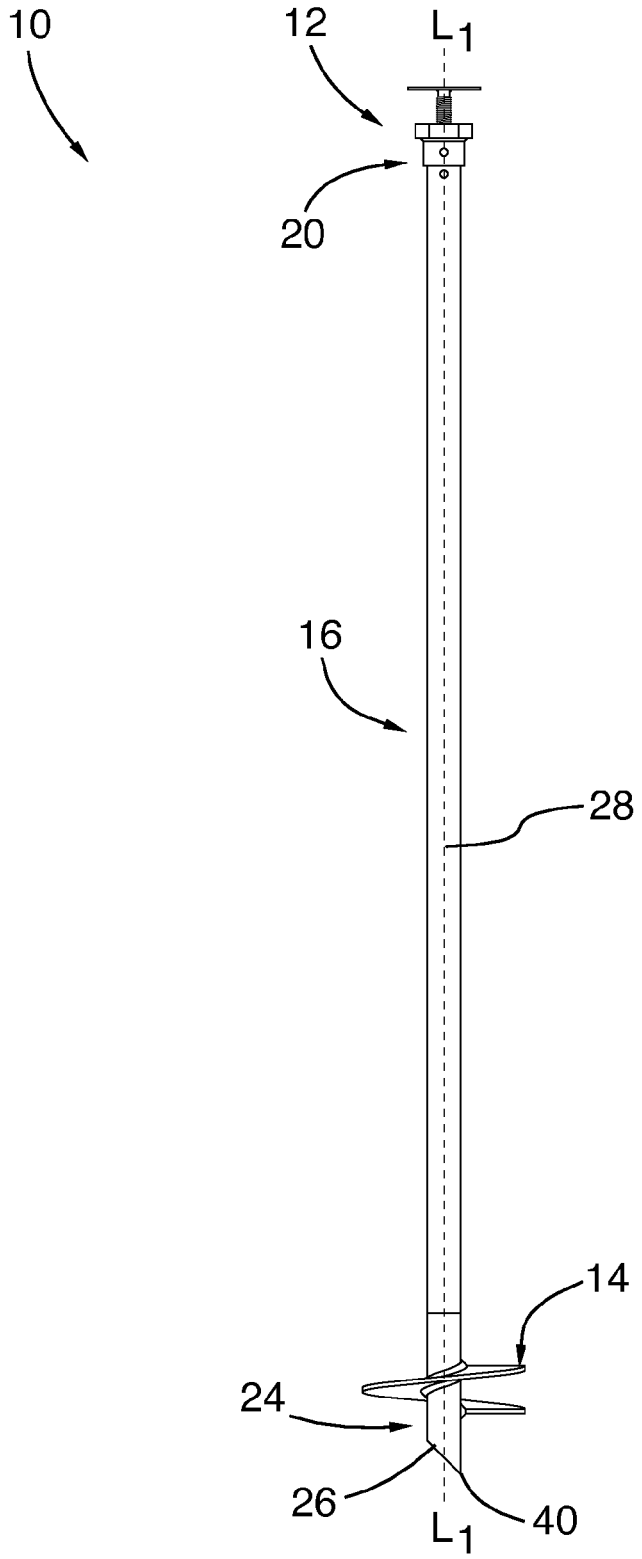
FIG. 2 is a side view of a screw pile according to one embodiment.
Figure 3A:
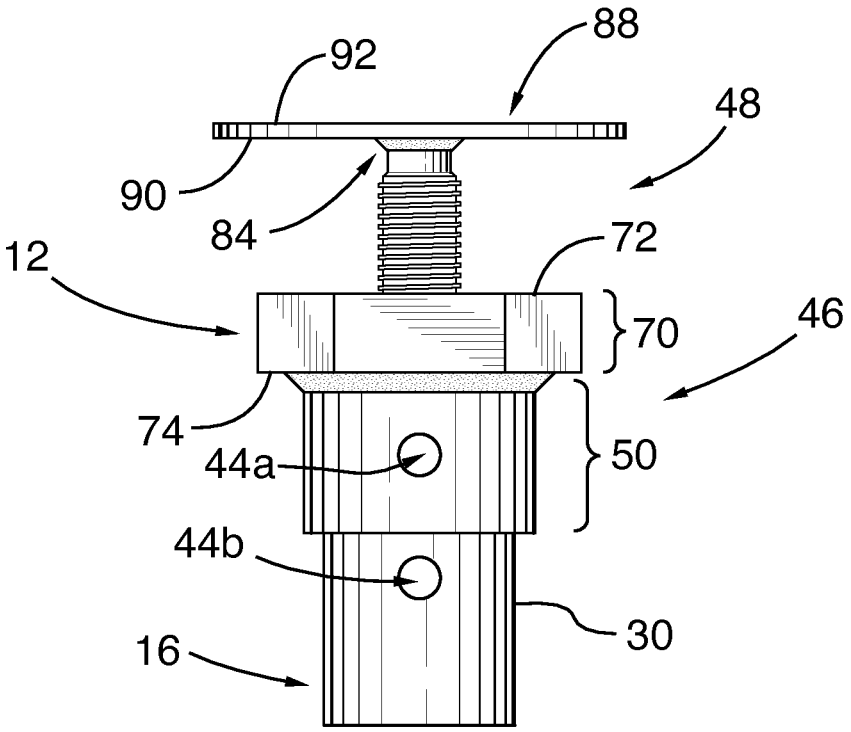
FIG. 3A is an enlarged, partial view of the screw pile of FIG. 2, showing the pile head.
Figure 3B:
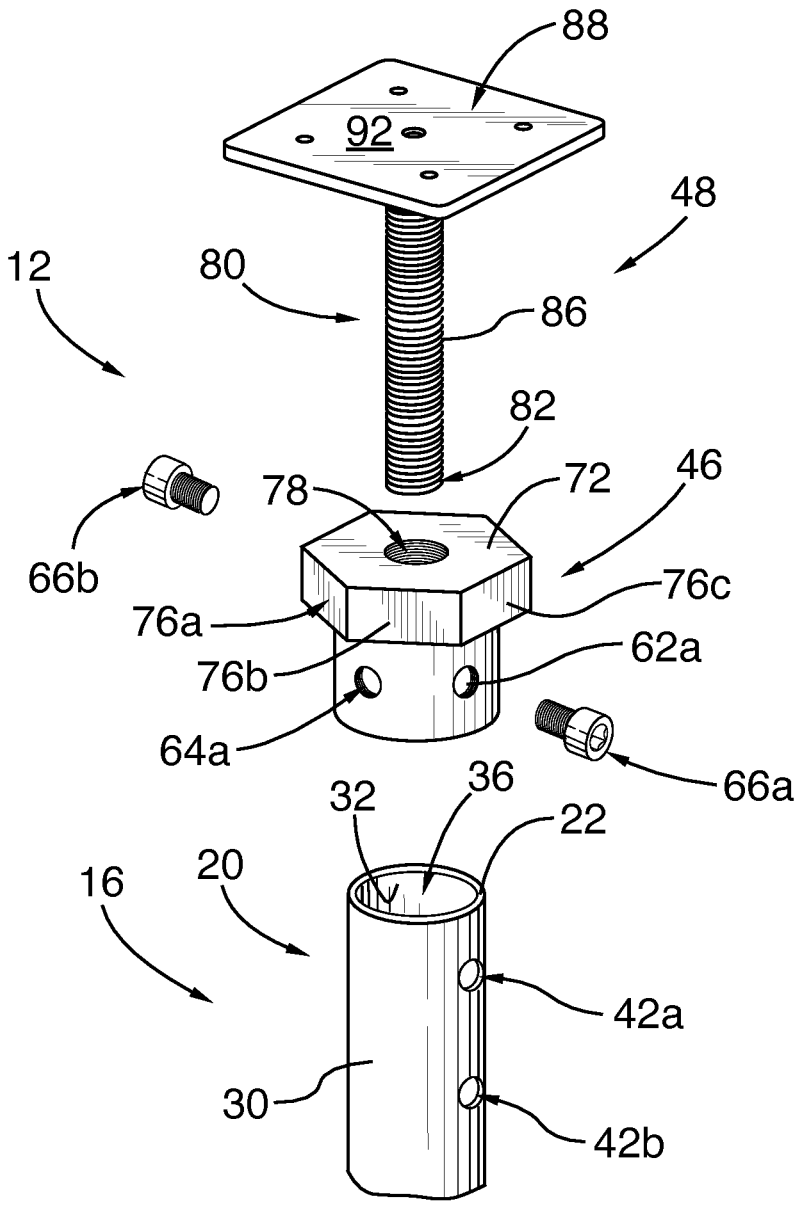
FIG. 3B is an exploded, perspective view of the pile head shown in FIG. 3A.
Figure 3C:
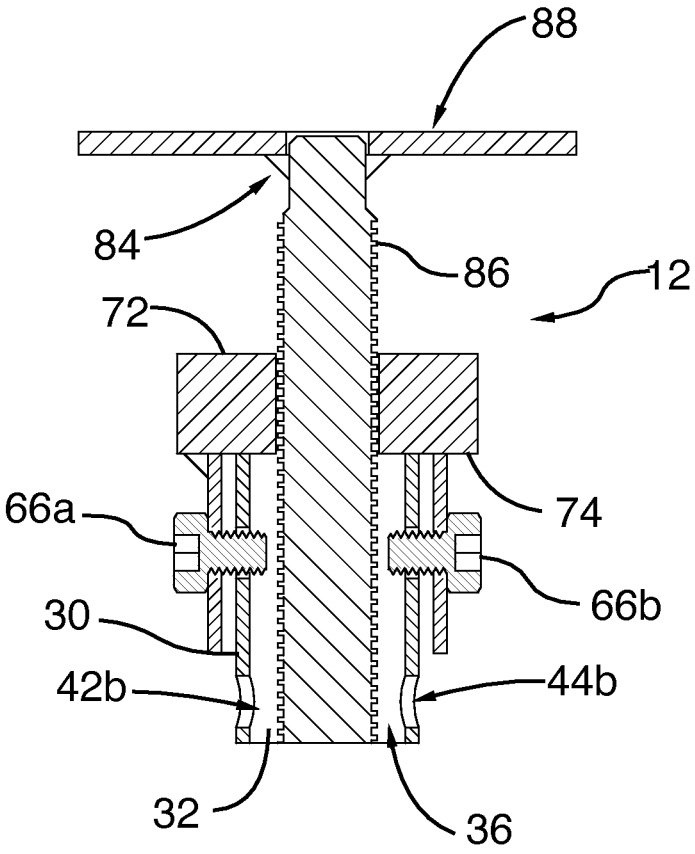
FIG. 3C is a cross-section view of the pile head shown in FIG. 3A.
Figure 4:
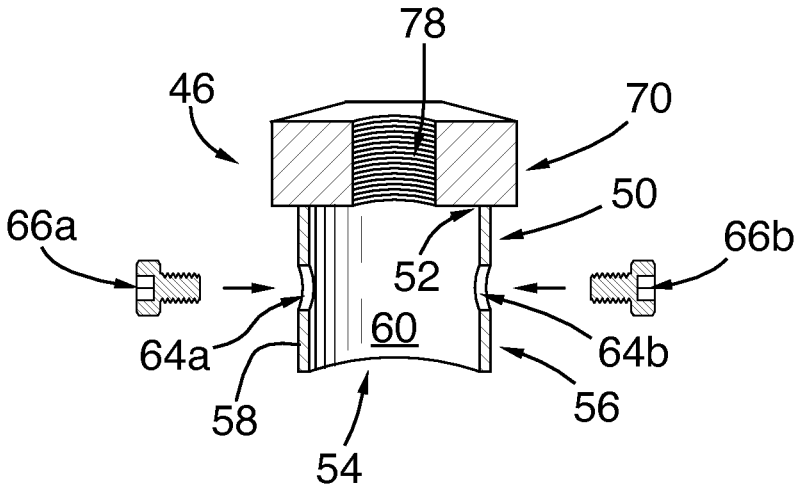
FIG. 4 is a cross-section view of the mounting portion of the pile head shown in FIG. 3A, with the threaded fasteners removed.

Referring to FIGS. 2 to 4, a screw pile 10 having one embodiment of pile head 12 will be described. The screw pile 10 may be used alone or in conjunction with other similar screw piles 10 to support a beam or a structure such as a fence, a deck, a sun room, a cart port, a cabin and the like. As it will become apparent below, the configuration of the pile head 12 can be adapted to securely receive such beam or structure. As it will become apparent below, the screw pile 10 could also be used horizontally or angularly, for instance to support wall or reinforce cliffs that are susceptible to collapse. The person skilled in the art will understand that in such a case, the movement of pile head 12 relative to the pile body 16, along the longitudinal axis $L_1$ thereof, is not vertical but rather horizontal or inclined relative to the horizontal.

In the illustrated embodiment, the screw pile 10 comprises an elongated cylindrical and hollow pile body 16 having a top end 20 terminating by an annular top edge 22 (best shown in FIG. 3B), as well as a bottom end 24 terminating by a generally annular bottom edge 26. Mounted to the top end 20 of the pile body 16 is the pile head 12. The screw pile further comprises an helical member 14 mounted to the bottom end 24 of the pile body 16, as it will become apparent below.

Extending between the top and bottom edges 22, 26 of the pile body 16 is a curved wall 28 having an outer curved face 30, an inner curved face 32 (best shown in FIG. 3B), as well as a longitudinal axis $L_1$ corresponding to the rotation axis of the screw pile 10 when it is being installed. Also extending between the top and bottom edges 22, 26 of the pile body 16, is an internal, cylindrical cavity 36, defined by the curved wall 28. As it will become apparent below, the cylindrical cavity 36, at the top end 20 of the pile body 16, is adapted to receive a portion of the pile head 12 for allowing movement thereof, along the longitudinal axis $L_1$.

In one embodiment, the pile body 16 is made of galvanized steel. Galvanised steel provides the advantages of being weather resistant and is less susceptible to corrosion and yet has sufficient mechanical strength to support heavy loads such as those associated with structures described above. It is however contemplated that the pile body 16 could be made of any other material that is adapted to resist weather condition and mechanical stresses and strains caused by the installation of the screw pile 10 and/or the loads associated with the structures supported by the screw pile 10.

In one embodiment, the cylindrical cavity 36, at the top end 20 of the pile body 16, is filled with a polyurethane material (not shown). In this embodiment, the polyurethane material is aimed at preventing water accumulation inside the cylindrical cavity 36 and to protect against damages that may be caused over time to the pile body 16 by frost. As it will be appreciated by a person skilled in the art, the cylindrical cavity 36 may be filled with other material such as, for instance, sand, stone screenings, concrete or any other type of material suitable for the purpose of filling the space and preventing water accumulation in the cylindrical cavity 36 and/or provide addition strength to the pile body 16. The person skilled in the art will also appreciate that the cylindrical cavity 36 could be left empty, for instance where the screw pile 10 is not subject to freezing/unfreezing cycles. In another embodiment, the outer curved face 30 of the pile body 16 can be covered with a protective layer or sleeve (not shown) to protect the pile body 16 against elements and to reduce abrasion caused by earth, sand or rock during the installation of the screw pile 10. In one embodiment, the protective layer is a silicone layer, but it is contemplated that other techniques and other types of protective layers could be used to protect the pile body 16. The person skilled in the art will also appreciate that even if such a protective layer may be desirable in some instances, it is not required.

To facilitate the installation of the screw pile 10, the bottom edge 26 of the pile body 16 is inclined relative to the longitudinal axis $L_1$, to define an angle $\theta_1$ (shown in FIG. 5) and a tip 40 of the pile body 16. In the illustrated embodiment, the angle $\theta_1$ is 45 degrees relative to the longitudinal axis $L_1$. It is however contemplated that other angles may be suitable. For instance, the angle $\theta_1$ could range from about 30 degrees to about 60 degrees relative to the longitudinal axis $L_1$ depending, for instance, on the type of soil in which the screw pile 10 is to be installed and/or the equipment used to carry out such installation. The person skilled in the art will further appreciate that such an angle $\theta_1$ could be 90 degrees, meaning that the bottom edge 26 would extend perpendicularly to the longitudinal axis $L_1$. In such a case, the pile body 16 would have not tip 40.

The pile body 16 can be sized and shaped to meet certain requirements dictated by the intended use, for instance the load to be carried by the screw pile 10 and the type of soil in which it is installed and the weather conditions. For instance, the length of the pile body 16 (i.e. the distance between the top edge 22 and the bottom edge 26) can be adapted such that the helical member 14 is positioned below the ground freezing zone when the screw pile 10 is installed. In one embodiment, the pile body 16 has a length of 85 inches (215.9 cm). It is also contemplated that the length, diameter and thickness of the pile body 16 may be selected according to its usage. In one embodiment the outer diameter of the pile body 16 (defined by the outer curved face 30) is selected from diameters of 1.875 inches (4.7625 cm), 2.375 inches (6.0325 cm) or 3.5 inches (8.89 cm). In another embodiment, the thickness of the curved wall 28 of the pile body 16 (i.e. the distance between the outer and inner curved faces 30, 32) is selected from thicknesses of 0.156 inch (0.39624 cm), 0.188 inch (0.47752 cm) or 0.25 inches (0.635 cm). It is however contemplated that the pile body 16 could have different dimensions. Further, while in the above described embodiment the pile body 16 has a cylindrical shape (i.e. a circular cross-section), it is contemplated that the pile body 16 could have a cross-section other than circular. For example, the pile body 16 could have a square, rectangular, triangular or oval cross-section.

At the top end 20 thereof, the pile body 16 is provided with two pairs of threaded bores 42*a*, 42*b* and 44*a*, 44*b*, which extend perpendicularly to the longitudinal axis $L_1$, between the outer and inner curved faces 30, 32 for securing the pile head 12 to the pile body 16. As best shown in FIGS. 3A and 3B, each pair of threaded bores comprises an upper bore 42*a*, 44*a* and a lower bore 42*b*, 44*b*, the upper bores 42*a*, 44*a* and lower bores 42*b*, 44*b* of each pair being longitudinally aligned to one another relative to the top and bottom ends 20, 24 of the pile body 16 and facing each other in radially opposed directions.

With reference to FIGS. 3A to 3C, the pile head 12 comprises mounting portion 46 for mounting the pile head 12 to the pile body 16 and an extendable portion 48 providing an adjustable interface between the mounting portion 46 of the pile head 12 and the structure or beam supported by the screw pile 10.

As best shown in FIG. 4, the mounting portion 46 of the pile head 12 includes a sleeve portion 50, which has the general configuration of a relatively short cylinder having a top end 52, a bottom end 54 and a curved wall 56 extending therebetween. The curved wall 56 of the sleeve portion 50 includes an outer curved face 58 and an inner curved face 60, the inner curved face 60 defining an internal diameter slightly larger than the external diameter of the pile body 16. As such, the top end 20 of the pile body 16 can be received into the sleeve portion 50 of the pile head 12 or, conversely, the sleeve portion 50 can engage the top end 20 of the pile body 16. While in the illustrated embodiment sleeve portion 50 of the pile head 12 is generally cylindrical, it could have other shapes, provided that it is sized and shaped to engage the top end 20 of the pile body 16. For example, should the pile body 16 have an oval cross-section, the sleeve portion 50 of the pile head 12 would have a matching oval cross-section.

Defined in the sleeve portion 50 of the pile head 12 are two pairs of radially opposed bores 62*a*, 62*b*, 64*a*, 64*b*. As it will become apparent below, each pair of threaded bores 62*a*, 62*b* or 64*a*, 64*b* is susceptible to collaborate with the upper bores 42*a*, 44*a* of the pile body 16 for securing the pile head 12 to the body 16 using a pair of fasteners 66*a*, 66*b*. While in the illustrated embodiment the pile head 12 comprises two pairs of bores 62*a*, 62*b*, and 64*a*, 64*b*, and the pile body 16 comprises 2 pairs of threaded holes 42*a*, 42*b* and 44*a*, 44*b*, it is contemplated that the pile head 12 and the pile body 16 could have a different number of bores and threaded holes, respectively. For example, the pile head 12 and the pile body 16 could each have two or three bores or holes. It is also contemplated that pile head 12 could be connected to the pile body 16 by fasteners other than bolts 66*a*, 66*b*. For example, the pile head 12 could be riveted to the pile body 16.

Secured to the top end 52 of the sleeve portion 50 is a plate portion 70, designed to abut the top edge 22 of the pile body 16 when the pile head 12 is positioned thereon. In the illustrated embodiment, the plate portion 70 is hexagonal and is configured to engage a tool such as a wrench (not shown) for adjusting the position of the mounting portion 46 relative to the pile body 16 and to the extendable portion 48 of the pile head 12, as it will become apparent below. As such, the plate portion 70 comprises a hexagonal top face 72, a hexagonal bottom face 74 in contact with the top end 52 of the sleeve portion 50, and 6 lateral faces 76*a* to 76*f* extending between the hexagonal top and bottom faces 72, 74 (only lateral faces 76*a*, 76*b* and 76*c* are identified with a reference numeral in the figs). In one embodiment, the hexagonal bottom face 74 of the plate portion 70 is welded to the top end 52 of the sleeve portion 50. Extending axially between the hexagonal top and bottom faces 72, 74 is a centrally disposed threaded hole 78 for receiving the extendable portion 48 of the pile head 12, as it will become apparent below.

The extendable portion 48 of the pile head 12 includes a threaded fastener 80 having a lower end 82, an upper end 84, and a threaded surface 86 extending therebetween. The threaded surface 86 is configured to threadably engage the threaded hole 78 defined on the plate portion 70. Secured at the upper end 84 of the threaded fastener 80 is supporting portion 88 sized and shaped to provide an adequate load bearing surface for the structure to be supported by the screw pile 10 and securing the same. In the illustrated embodiment, the supporting portion 88 has the general configuration of a square plate and comprises a lower face 90 in contact with the top end 84 of the threaded fastener 80 and an upper face 92, configured to receive thereon a portion of the structure to be supported. In the embodiment illustrated, the supporting portion 88 and the threaded fastener portion 80 are centrally aligned. In an alternate embodiment, the supporting portion 88 could be offset relative to the threaded fastener 80 or could have a different configuration. For instance, the supporting portion 88 could have a U-shape, a V-shape or any other shape that is suitable for receiving a structure having a defined shape. As it will be apparent, a rotation movement of the extendable portion 48 and the mounting portion 46 relative to one another in one direction (e.g. clockwise) will allow displacement of the supporting portion 88 relative to the pile body 16 in one direction along the longitudinal axis $L_1$ while a rotation in the opposite direction (e.g. counter clockwise) will allow the displacement of the supporting portion 88 in the opposite direction, thereby allowing adjustment of the pile head 12 before the structure or after the structure is disposed thereonto. More specifically, configuration of the pile head 12 permits a vertical adjustment of the screw pile 10 without having to lift the structure from the pile head 12 for allowing rotation of the extendable portion 48, while enabling securing the pile head 12 to the pile body 16 of the screw pile 10 to prevent unwanted vertical movement of the pile head 12 relative to the pile body 16. In other words, the above described pile head configuration allow the screw pile 10 to work both in compression and in tension and yet provide adjustment along the longitudinal axis $L_1$. Accordingly, while in the illustrated embodiment the plate portion 70 is generally hexagonal to engage a tool, it is contemplated that the plate portion 70 could have a different shape. For example, the plate portion 70 of the pile head 12 could be square or pentagonal, or could include grooves or protrusions for engaging a corresponding tool. The plate portion 70 could even be circular, preferably in a manner that would allow a rotation of the mounting portion 46 of the pile head 12 relative to the pile body 16 and to the extendable portion 48, for allowing longitudinal adjustment of the extendable portion 48 when the screw pile 10 is installed and a structure is supported thereto.

While in the above-described embodiment the pile head 12 is mounted to a pile body 16 of a screw pile 10, it is contemplated that it could be mounted to a structure that is different than a pile body 16 of the screw pile 10. For instance, the pile head 12 could be mounted to a pipe or tubular support anchored in a concrete foundation. Further, it is contemplated that the fasteners 66*a*, 66*b* may not be required where the pile head 12 is being used to work in compression only. Also, intermediate structures such as rubber seals may be positioned in various locations, including between the pile head 12 and the pile body 16, or about the fasteners 66*a*, 66*b*, to reduce water infiltration into the cylindrical cavity 36 of the pile body 16.

Figure 5:
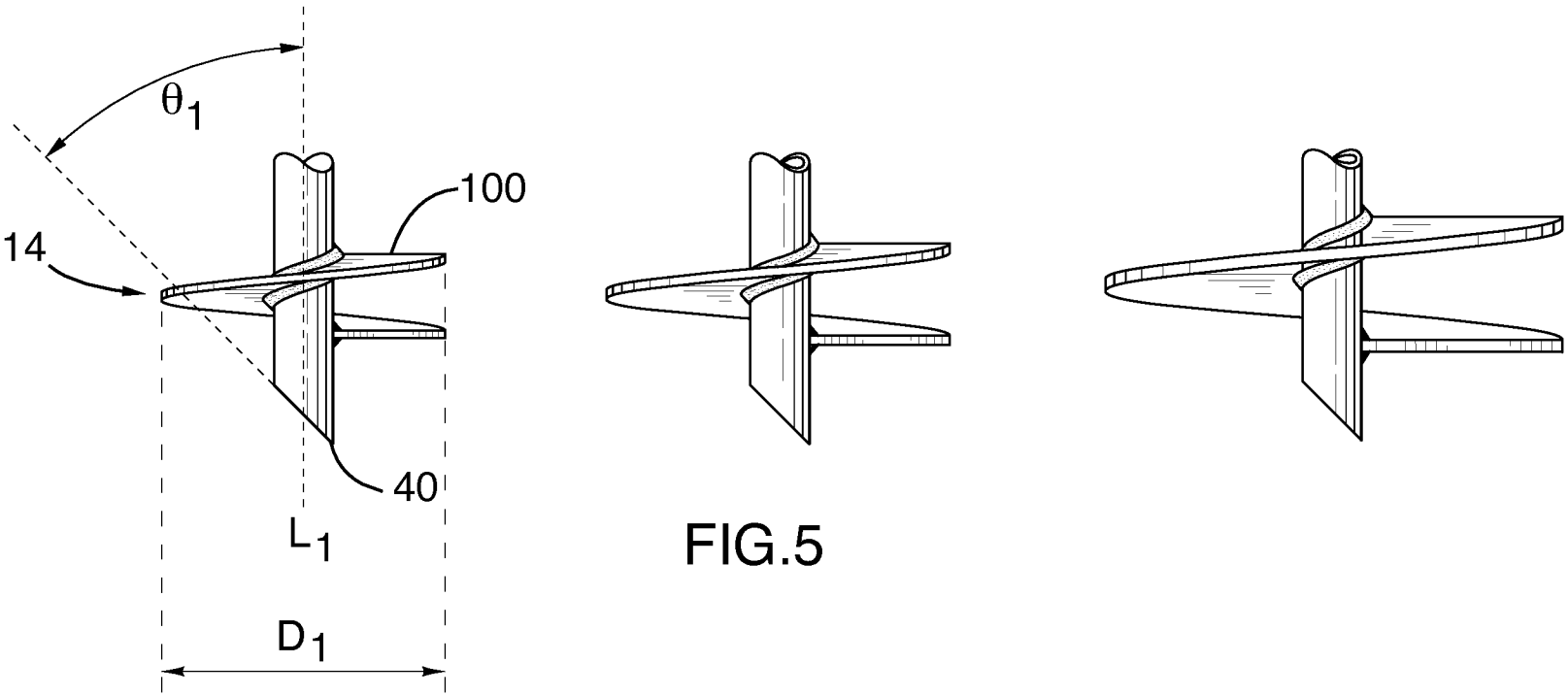
FIG. 5 is a side view of helical members in accordance with one embodiment.

With reference to FIG. 5, the helical member 14 mounted to the bottom end 24 of the pile body 16 will now be described. In this embodiment, the helical member 14 is adapted to engage a soil material and to force the pipe body 16 to move thereinto when the pile body is rotated about its longitudinal axis. Once the screw pile 10 is properly positioned, it provides resistance against movement of the screw pile 10 along the longitudinal axis, as it will be appreciated by those skilled in the art. In the embodiment illustrated in FIG. 5, the helical member 14 comprises a twisted plate member 100 fixedly attached, to the lower end 24 of the pile body 16, preferably by welding. In one embodiment, the helical member 14 has a diameter $D_1$ and a number of threads adapted to the material in which the screw pile 10 is to be installed, as well as the to the load to be supported. Further, the screw pile 10 could comprise more than one helical member. In non-limitative examples, the helical member 14 has a diameter $D_1$ selected from an 8 inch (20.32 cm) diameter (e.g. to support relatively light structures, such as balconies and galleries, patios, sheds and fences), an 11 inch (27.94 cm) diameter (e.g. to support medium weight structures, such as docks, solarium and walk ways) or a 13 inch (33.02 cm) diameter (e.g. to support heavier structures, such as cabins, permanent or temporary agricultural infrastructures, extensions, building foundations, and bridges).

Figure 6:
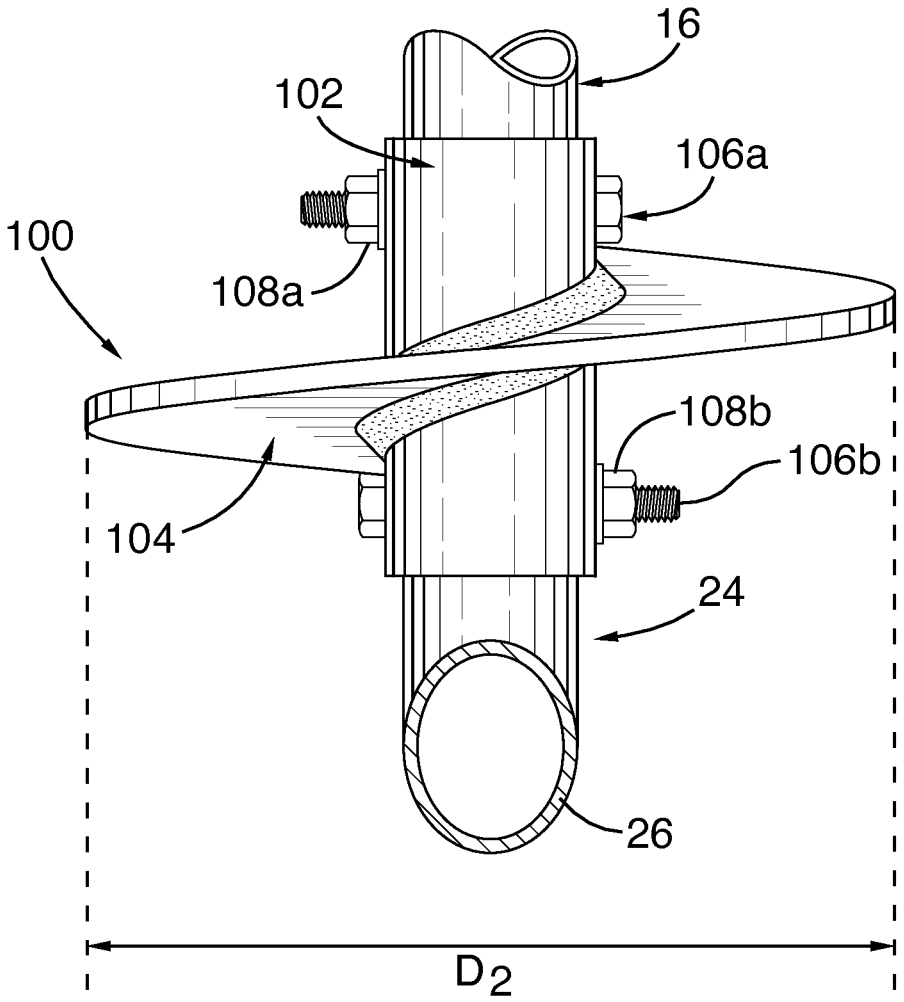
FIG. 6 is a side view of a helical members, in accordance with another embodiment.
Figure 7:
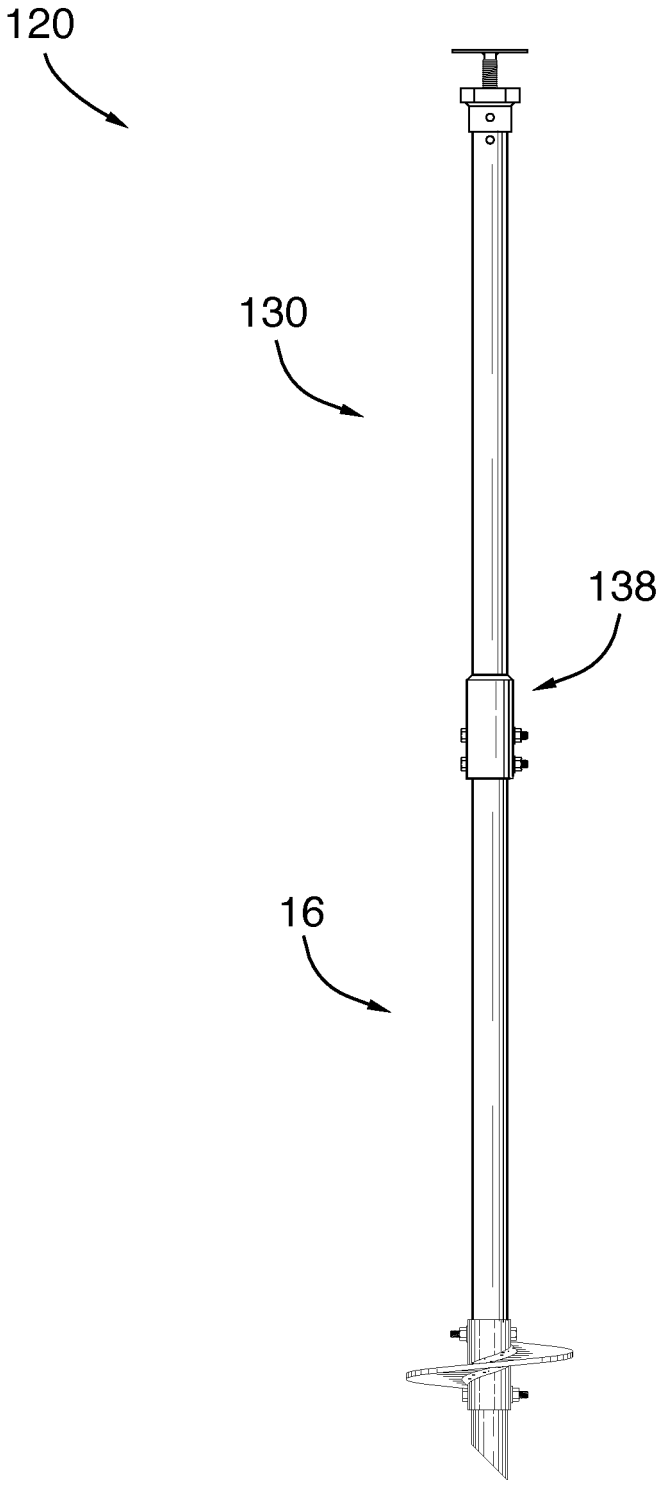
FIG. 7 is a side view of a screw pile in accordance with another embodiment.

FIGS. 6 and 7 show another embodiment of an helical member 100 to be used in conjunction with a screw pile such as screw pile 10. In this embodiment, instead of being permanently welded to the pile body 16, the helical member 100 is removable. As such, the helical member 100 could be described as a helix adaptor.

In this embodiment, the helical member 100 includes a sleeve portion 102 adapted to engage the lower end 24 of the pile body 16, and a twisted plate member 104 securely fastened to the sleeve portion 102 and defining a helix thereonto. In non-limitative examples, the helical member 100 has a diameter $D_2$ selected from a of 8 inches (20.32 cm) diameter (e.g. to support relatively light structures, such as balconies and galleries, patios, sheds and fences), a 11 inches (27.94 cm) diameter (e.g. to support medium weight structures, such as docks, solarium and walk ways) or a 13 inches (33.02 cm) diameter (e.g. to support heavier structures, such as cabins, permanent or temporary agricultural infrastructures, extensions, building foundations, and bridges).

Defined on the sleeve portion 102 of the helical member 100 are two pairs of radially opposed holes not shown. The holes of the helical member 100 coincide with apertures (not shown) defined on the lower portion 24 of the pile body 16 to receive a corresponding pair of bolts 106*a*, 106*b* therein. As best shown in FIG. 6, the bolts extend on one side of the helical member 100 to receive a corresponding pair of nuts 108*a*, 108*b* to secure the helical member 100 to the lower end 24 of the pile body 16. As such, the helical member 100 is removable from the pile body 16. This embodiment of helical member 100 provides distinct advantages over prior art configurations of helical members. For instance, the use of the helical members such as helical member 100 provides with a greater flexibility with respect to the onsite installation of screw piles. More specifically, since it is oftentimes difficult to evaluate soil conditions, required screw pile length and load to be supported while offsite, manufacturers, distributors and/or installers of screw piles can transport a variety of pile bodies (e.g. having various length and diameters and a variety of helical members (e.g. having different diameters, number of threads and different sizes of sleeves) and assemble pile bodies onsite. Accordingly, because of the configuration of the helical member 100, one can use a same pile body and attach thereonto helical member 100 having various characteristics (size, number of threads) for the intended purpose and/or ground conditions. Because the helical members 100 are detachable from the pile body 16, they also tend to make storage in warehouses and/or trucks easier because less space is required than for screw piles provided with helical members fixedly mounted to the pile body, which may also be found to be advantageous in some circumstances.

Figure 8:
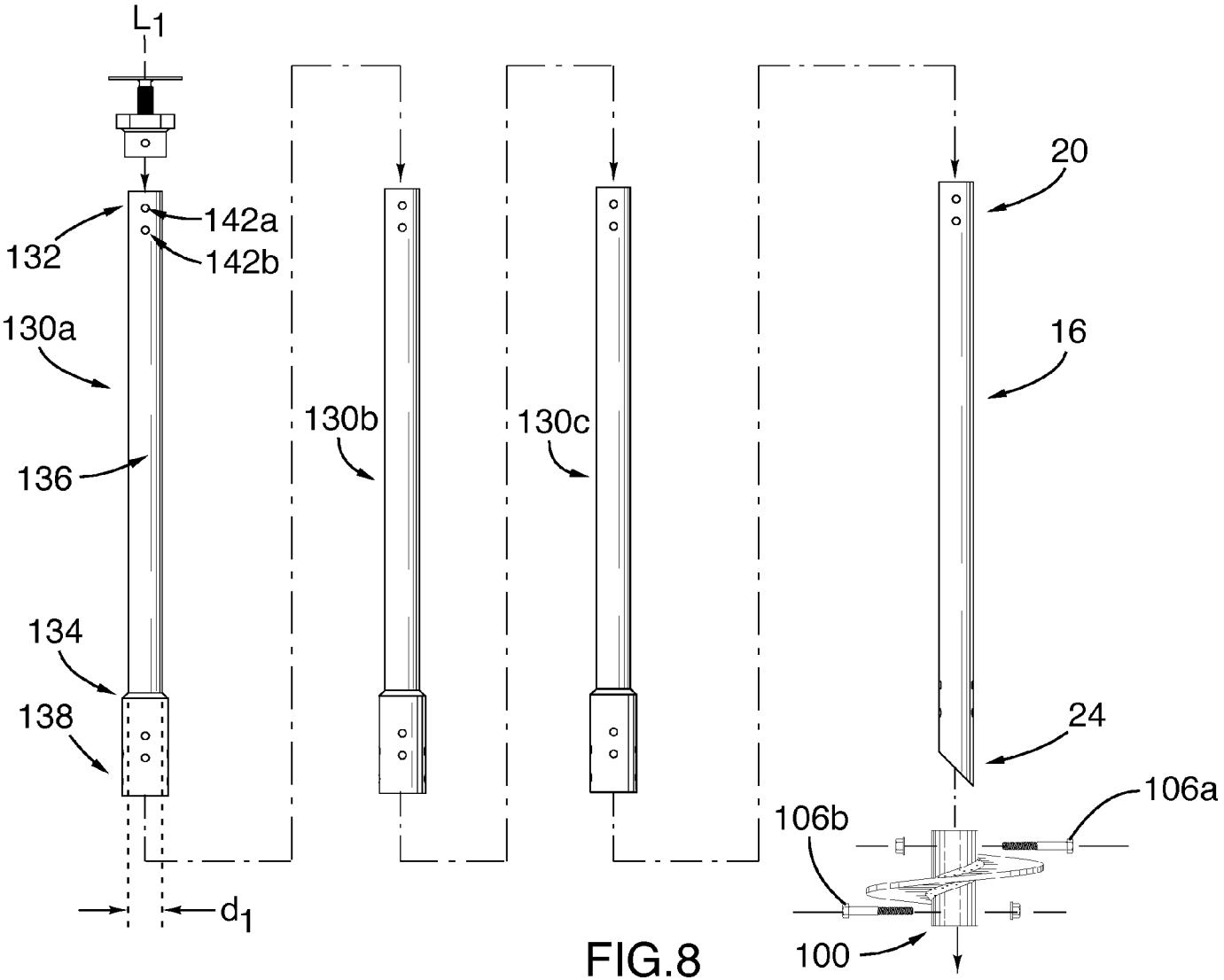
FIG. 8 is a side, exploded view of a screw pile in accordance with yet another embodiment, with three body extensions.

According to another embodiment, shown in FIGS. 7 to 9C, a screw pile 120 comprises a pile body 16 to which are attached one or more body extensions 130 (in the case of FIG. 7 only one body extension 130 is shown while three body extensions 130*a*-130*c* are shown in FIG. 8) provided to extend the length of the screw pile 120. The body extensions 130*a*-130*c* being identical, only body extension 130*a* will be described.

The body extension 130*a* includes a top end 132, a lower end 134 and a cylindrical wall 136 extending therebetween. Provided at the top end 132 are two pairs of threaded bores 142*a*, 142*b*, 144*a*, 144*b* (only threaded bores 142*a* and 142*b* are shown in FIG. 8), which extend perpendicularly to the longitudinal axis $L_1$, similarly to threaded bores 42*a*, 42*b* and 44*a*, 44*b* of the pile body 16, adapted to secure a pile head 12 or another body extension (e.g. 130*b*), as it will become apparent below.

Figure 9A:
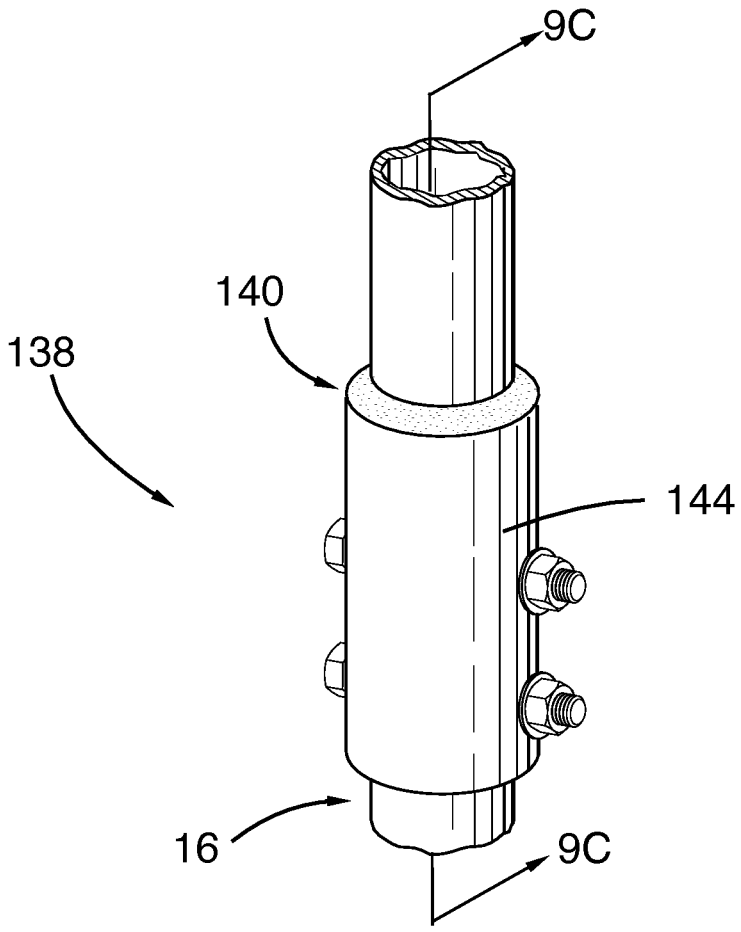
FIG. 9A is a side perspective view of the connecting portion of the body extension of the screw piles shown in FIGS. 7 and 8.
Figure 9B:
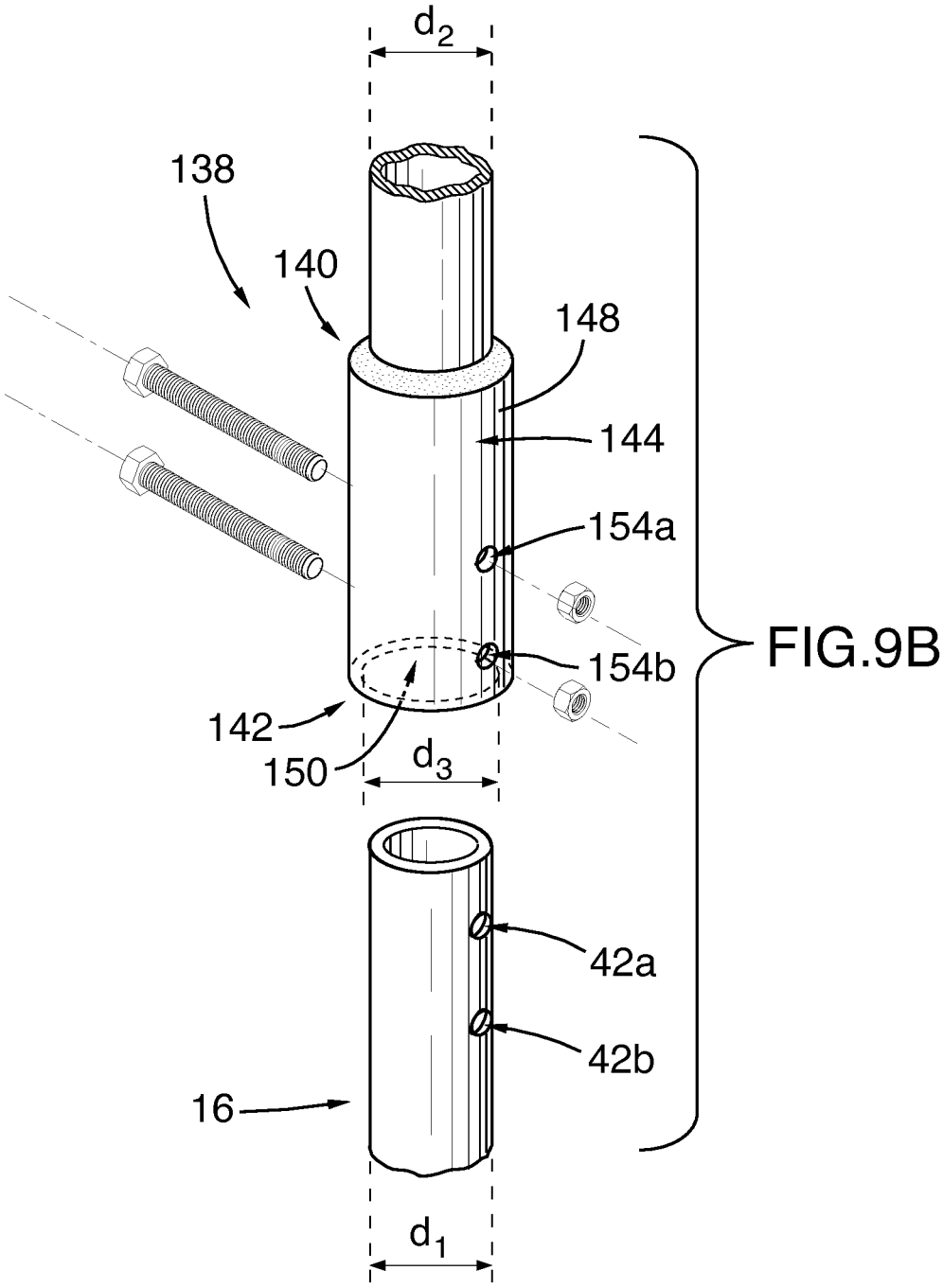
FIG. 9B is an exploded, perspective view of the connecting portion shown in FIG. 9A.
Figure 9C:
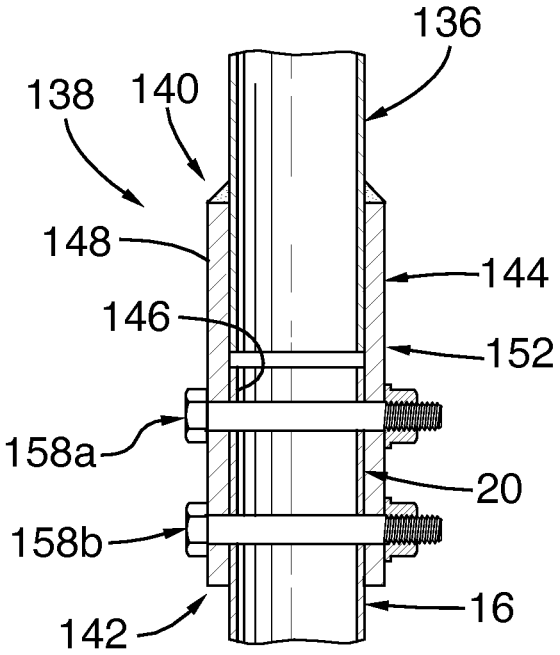
FIG. 9C is a cross-section view of the connecting portion shown in FIG. 9A.

The body extension 130 is preferably made of galvanized steel, similarly to the pile body 16, and the cylindrical wall 136 has a diameter $d_2$, which correspond to the diameter $d_1$ of the pile body 16. At the bottom end 134 thereof, the body extension 130 is provided with a connecting portion 138. With reference to FIGS. 9A to 9C, the connecting portion 138 has the general configuration of a cylindrical sleeve partially engaging cylindrical wall 136, at the lower end 134. More specifically, the connecting portion 138 comprises a top end 140, a bottom end 142 and a cylindrical wall 144 extending therebetween. The cylindrical wall 144 has an inner curved face 146 and an outer curved face 148. The inner curved face 146 defines an inner cylindrical cavity 150 having a diameter $d_3$, which is adapted to allow engagement of the connection portion 138 about the cylindrical wall 144 of the body extension 130. As such, the diameter $d_3$ is slightly larger than the diameter $d_1$. In the illustrated embodiment, the connecting portion 138 is engaged about the cylindrical wall 136 from the top end 140 to an intermediate region 152 located between the top end 140 and the lower end 142. In one embodiment, the connecting portion 138 is secured to the cylindrical wall 136 by welding, preferably at the top end 140 of the connecting portion 138 (i.e. outside the connecting portion 138) and at the intermediate location 152, in the internal cylindrical cavity 150. As it will be appreciated by one skilled in the art, different manufacturing options are available to provide a body section with a connecting portion. For instance, the connecting portion 138 and the cylindrical wall 136 could be integrally formed. It is also contemplated that the body extension 130 could have a shape and size different from illustrated in the figures as long as it is sized and shaped to connect with sufficient resistance to a pile body 16 or to another body extension 130.

Provided between the intermediate position 152 and the lower end 142 of the connection portion 138 are two pairs of radially opposed holes 154*a*, 154*b*, 156*a*, 156*b* for receiving fasteners 158*a*, 158*b* and fastening the top end 20 of the pile body 16 to the bottom end 134 of the body extension 130. As best shown in FIG. 9C, when the top end 20 of the pile body 16 (or the top end 132 of another body extension 130) is received in the internal cylindrical cavity 150 of the connecting portion 138, the two pairs of holes 42*a*, 42*b*, 44*a*, 44*b* of the pile body 16 (or of another body extension 130) are in alignment with the corresponding two pairs of holes 154*a*, 154*b* and 156*a*, 156*b* respectively (only holes 154*a* and 154*b* being shown), of the connecting portion 138 to receive the pair of fasteners 158*a*, 158*b*, to thereby secure the body extension 130 to the pile body 16 (or to another body extension 130). In the illustrated embodiment, the fasteners 158*a* are bolts and nuts, but it is contemplated that other kind of fasteners could be used such as, for instance, rivets. Other ways of connecting a body extension 130 of a screw pile are contemplated. As it will be appreciated, using body extensions 130 allows a greater onsite flexibility, similarly to the use of a removable helical member. Indeed, it becomes possible to have screw piles of variable length without having to carry or store pile bodies 16 of variable length. Further, the use of body extensions tends to facilitate the installation of long screw piles since the equipment used for installation (e.g. a mini-excavator provided with a hydraulic tool) does not need to be configured particularly to handle extra-long pile bodies, as it will become apparent below. Further, having a pile body made of two or more sections (e.g. one pile body and one or more body extensions) connected to each other via connecting portions 138 may strengthen long piles and reduce risks of movements of the pile. In such a case, the connecting portions would then act as a reinforced joint.

Having described the general configuration of the screw pile 10, a method of installation and adjustment of the screw pile 10 will now be described. In a first step, a worker evaluates the conditions of the ground on which the structure needs to be supported. Based on his or her assessment, the worker selects the length of pile body 16 required to ensure that the helical member 14 will be positioned at an adequate depth, as well as proper helical member parameters to ensure adequate support (e.g. a larger helix diameter for heavy structure and/or soft soil). If the helical member is a removable helical member 100, the worker positions the sleeve portion 102 of the helical member 100 about the lower end 24 of the pile body 16, aligns the holes of the helical member 100 with those of the pile body 16 and engages the threaded fasteners 106*a*, 106*b* therein. Once the threaded fasteners (i.e. the bolts) are properly positioned in the holes, the installer secures the nuts. Where the helical member 14 is welded directly to the pile body 16, the installation step of the helical member 14 to the pile body 16 is generally carried out in a manufacturing plant rather than onsite.

The pile body 16 provided with the helical member 14 or 100 is then inserted into the ground at a location corresponding to a location where they will be used as a support to the structure. A heavy duty machine such as a hydraulic rotating tool mounted on a small excavator is preferably used to rotate the pile body so that the helical member 14 or 100 mounted at the lower end 24 of the pile body 16 engages a portion of the soil and forces the helical member 14 or 100 and the pile body 16 attached thereto to move into the ground until reaching the desired depth. Once placed in the ground, the upper end 20 of the pile body 16 extends above the ground level.

Based on the required screw pile length, the worker may choose to use one or more body extensions 130. If such is the case, the worker positions a body extension 130 to the top end 20 of the pile body 16 already installed in the soil. The worker aligns the pair of holes 154*a*, 154*b* and 156*a*, 156*b* of the connection portion 138 of the body extension 130 with the corresponding holes 42*a*, 42*b* and 44*a*, 44*b*, at the top end 20 of the pile body 16 (or of another body extension 130, if more than one body extensions are used). At that point, the worker positions fasteners 158*a*, 158*b* in the holes to secure the body extension 130 to the pile body 16, and the pile body 16 and the body extensions 130 are ready for a further installation operation. More specifically, the worker uses its rotating tool, this time mounted to the top end 132 of the body extension 130, to rotate the pile body 16 and the body extension 130 attached thereto, the helical member 14 or 100 forcing the pile body 16 and the extension 130 further deep into the ground.

Once a proper length has been achieved, the pile head 12 is positioned on the upper end 20 of the pile body 16. More specifically, the sleeve portion 50 is engaged about the cylindrical wall 28 of the pile body 16 (or the cylindrical wall 136 of a body extension 130), until the bottom face 74 of the plate portion 70 abuts the top edge 22 of the pile body 16 (or of the body extension 130, as the case may be). At that point, the extendable portion 48 of the pile head 12 is adjusted to a desired height so that the screw pile 10 is properly leveled to receive a structure thereon.

Once the structure is received on or supported by the extendable portion 48 of the pile head 12, it may become more difficult to fine tune a level adjustment, either because of the structure it is secured thereto (for instance a wooden beam secured to the plate of the extendable portion by way of screws), because the configuration of the extendable portion 48 does not permit rotation (e.g. a U-shaped supporting portion engaging two faces of a vertically extending wooden post) or because the weight of the supported structure causes a frictional engagement too significant to allow rotation of the extendable portion 48. Where such level fine tuning is required, the worker uses a tool such as a wrench engage the plate portion 70 and to rotate the mounting portion 46 of the pile head 12 relative to the pile body 16 (or the body extension 130, as the case may be), where rotation movement in one rotation direction causes an upward movement of the extendable portion 48 and while movement in the other rotation direction causes downward movement of the extendable portion 48. Once the height of the extendable portion 48 is proper, the worker secures the pile head 12 to pile body 16 (or the body extension 130, as the case may be) by fastening the bolts 66*a*, 66*b* into the bores 62*a*, 62*b* or 64*a*, 64*b* and holes 42*a*, 44*a* of the pile head 12 and pile body 16, respectively. By having the pile head 12 secured to the pile body 16 in this manner, as opposed to merely maintaining it by way of gravity, the pile head 12 is prevented from moving away from the pile body 16, in the longitudinal direction. As such, the screw pile can work both in compression and in tension, therefore allowing its use in a variety of applications, in addition to improve the safety. Further, it will be appreciated that such a pile head 12 configuration allows further level adjustments (e.g. after a number of soil freezing/unfreezing cycles or soil compaction over the years) and yet, preserve the above mentioned advantages. Where such further level adjustments are required, a worker simply removes the fasteners 66*a*, 66*b*, rotates the mounting portion 46 of the pile head 12 in the direction appropriate to reach the desired level, and secures back the fasteners 66*a*, 66*b*.

Modifications and improvements to the above-described embodiments of the present may become apparent to those skilled in the art. The foregoing description is intended to be exemplary rather than limiting. The scope of the present is therefore intended to be limited solely by the scope of the appended claims.

We claim:

1. A screw pile comprising:

a pile body having a top end, a bottom end and a wall extending therebetween, the pile body defining a longitudinal axis of the screw pile, the pile body further including at least one bore defined at the top end;

a helical member mounted to the bottom end of the pile body;

a pile head mounted to the top end of the pile body, the pile head including:

a mounting portion including:

a sleeve portion engaging the top end of the pile body and at least one hole defined in the sleeve portion, the at least one hole of the sleeve portion being in alignment with the at least one bore of the pile body; and a plate portion fixedly secured to a top end of the sleeve portion, the plate portion comprising a threaded hole extending along the longitudinal axis; and an extendable portion movably mounted to the mounting portion, the extendable portion being movable relative to the mounting portion, along the longitudinal axis, the extendable portion comprising a threaded shaft threadably engaging the threaded hole of the plate portion; and at least one fastener extending through the at least one hole of the sleeve portion and the at least one bore of the pile body for removably fastening the mounting portion of the pile head to the top end of the pile body.

2. A screw pile according to claim 1, wherein the threaded shaft of the extendable portion comprises a top end, a bottom end and a threaded surface extending therebetween, the extendable portion further comprising a support member mounted to the top end of the threaded shaft.

3. A screw pile according to claim 2, wherein the support member is configured to support a structure thereon.

4. A screw pile according to claim 3, wherein the structure is selected from a group consisting of a beam, a fence, a deck, a sun room, a cart port and a cabin.

5. A screw pile according to claim 1, wherein the pile body and the sleeve portion of the mounting portion of the pile head are generally cylindrical.

6. A screw pile according to claim 5, wherein the plate portion of the mounting portion is configured to receive a tool for urging rotation of the mounting portion relative to the pile body when the at least one fastener is removed, thereby urging movement of the extendable portion relative to the mounting portion, along the longitudinal axis.

7. A screw pile according to claim 6, wherein the plate portion comprises a top face, a bottom face in contact with the sleeve portion and at least one side face extending between the top and bottom faces.

8. A screw pile according to claim 7, wherein the top and bottom faces of the plate portion are hexagonal.

9. A screw pile according to claim 1, wherein the at least one fastener is threaded.

10. A screw pile according to claim 9, wherein the at least one bore defined at the top end of the pile body is a threaded bore and the at least one fastener includes at least one bolt, the at least one bolt engaging the threaded bore of the pile body.

11. A screw pile according to claim 1, wherein the helical member is removable.

12. A screw pile according to claim 11, wherein the removable helical member comprises a sleeve portion engageable about the bottom end of the pile body, a twisted member secured to the sleeve portion of the removable helical member and defining a helix, and at least one second fastener for fastening the removable helical member to the bottom end of the pile body.

13. A screw pile according to claim 12, wherein the removable helical member comprises at least one pair of holes defined in the sleeve portion thereof, and the bottom end of the pile body comprises at least one pair of corresponding holes, the holes of the removable helical member being in alignment with the holes defined at the bottom end of the pile body to receive the at least one second fastener therein.

14. A screw pile according to claim 13, wherein the at least one second fastener is threaded.

15. A screw pile according to claim 14, wherein the at least one second fastener includes at least one bolt and at least one nut.

16. A kit for a screw pile according to claim 1.

17. A screw pile comprising:

a pile body having a top end, a bottom end and a wall extending therebetween, the pile body defining a longitudinal axis of the screw pile;

at least one body extension mounted to the top end of the pile body, the at least one body extension having:

a top end, a bottom end and a wall extending therebetween, the body extension further having at least one bore defined at the top end thereof;

a connection portion at the bottom end of the at least one body extension, the top end of the pile body being engaged in the connection portion of the body extension; and at least one fastener extending through the pile body and the wall of the body extension for removably fastening the body extension to the pile body;

a helical member mounted to the bottom end of the pile body;

a pile head mounted to the top end of the at least one body extension, the pile head including:

a mounting portion including:

a sleeve portion engaging the top end of the pile body and at least one hole defined in the sleeve portion, the at least one hole of the sleeve portion being in alignment with the at least one bore of the pile body; and a plate portion fixedly secured to a top end of the sleeve portion, the plate portion comprising a threaded hole extending along the longitudinal axis; and an extendable portion movably mounted to the mounting portion, the extendable portion being movable relative to the mounting portion, along the longitudinal axis, the extendable portion comprising a threaded shaft threadably engaging the threaded hole of the plate portion; and at least one second fastener extending through the at least one hole of the sleeve portion and the at least one bore of the body extension for removably fastening the mounting portion of the pile head to the top end of the body extension.

18. A screw pile according to claim 17, wherein the threaded shaft of the extendable portion comprises a top end, a bottom end and a threaded surface extending therebetween, the extendable portion further comprising a support member mounted to the top end of the threaded shaft.

19. A screw pile according to claim 18, wherein the support member is configured to support a structure thereon.

20. A screw pile according to claim 19, wherein the structure is selected from a group consisting of a beam, a fence, a deck, a sun room, a cart port and a cabin.

21. A screw pile according to claim 17, wherein the body extension and the sleeve portion of the mounting portion of the pile head are generally cylindrical.

22. A screw pile according to claim 21, wherein the plate portion of the mounting portion is configured to receive a tool for urging rotation of the mounting portion relative to body extension when the at least one second fastener is removed, thereby urging movement of the extendable portion relative to the mounting portion, along the longitudinal axis.

23. A screw pile according to claim 22, wherein the plate portion comprises a top face, a bottom face in contact with the sleeve portion and at least one side face extending between the top and bottom faces.

24. A screw pile according to claim 23, wherein the top and bottom faces of the plate portion are hexagonal.

25. A screw pile according to claim 17, wherein the at least one second fastener is threaded.

26. A screw pile according to claim 25, wherein the at least one bore defined at the top end of the body extension is a threaded bore and the at least one second fastener includes at least one bolt, the at least one bolt engaging the threaded bore of the body extension.

27. A screw pile according to claim 17, wherein the helical member is removable.

28. A screw pile according to claim 27, wherein the removable helical member comprises a sleeve portion engageable about the bottom end of the pile body, a twisted member secured to the sleeve portion of the removable helical member and defining a helix, and at least one third fastener for fastening the removable helical member to the bottom end of the pile body.

29. A screw pile according to claim 28, wherein the removable helical member comprises at least one pair of holes defined in the sleeve portion thereof, and the bottom end of the pile body comprises at least one pair of corresponding holes, the holes of the removable helical member being in alignment with the holes defined at the bottom end of the pile body to receive the at least one third fastener therein.

30. A screw pile according to claim 29, wherein the at least one third fastener is threaded.

31. A screw pile according to claim 30, wherein the at least one third fastener includes at least one bolt and at least one corresponding nut.

32. A pile head for a pile having a top end, a longitudinal axis, and at least one bore defined at the top end, the pile head comprising:

a mounting portion including:

a sleeve portion engaging the top end of the pile body and at least one hole defined in the sleeve portion, the at least one hole of the sleeve portion being in alignment with the at least one bore of the pile body; and a plate portion fixedly secured to a top end of the sleeve portion, the plate portion comprising a threaded hole extending along the longitudinal axis;

an extendable portion movably mounted to the mounting portion, the extendable portion being movable relative to the mounting portion, along the longitudinal axis, the extendable portion comprising a threaded shaft threadably engaging the threaded hole of the plate portion; and at least one fastener extending through the at least one hole of the sleeve portion and the at least one bore of the pile body for removably fastening the mounting portion of the pile head to the top end of the pile.

33. A pile head according to claim 32, wherein the pile is a screw pile.

34. A pile head according to claim 32, wherein the threaded shaft of the extendable portion comprises a top end, a bottom end and a threaded surface extending therebetween, the extendable portion further comprising a support member mounted to the top end of the threaded shaft.

35. A pile head according to claim 34, wherein the support member is configured to support a structure thereon.

36. A pile head according to claim 35, wherein the structure is selected from a group consisting of a beam, a fence, a deck, a sun room, a cart port and a cabin.

37. A pile head according to claim 32, wherein the pile and the sleeve portions of the mounting portion of the pile head are generally cylindrical.

38. A pile head according to claim 37, wherein the plate portion of the mounting portion is configured to receive a tool for urging rotation of the mounting portion relative to body extension when the second fastening means is removed, thereby urging movement of the extendable portion relative to the mounting portion, along the longitudinal axis.

39. A pile head according to claim 38, wherein the plate portion comprises a top face, a bottom face in contact with the sleeve portion and at least one side face extending between the top and bottom faces.

40. A pile head according to claim 39, wherein the top and bottom faces of the plate portion are hexagonal.

41. A pile head according to claim 32, wherein the at least one fastener is threaded.

42. A pile head according to claim 41, wherein the at least one bore defined at the top end of the pile is a threaded bore and the at least one threaded fastener includes at least one bolt, the at least one bolt engaging the threaded bore of the pile.

* * * * *